United States Patent [19]

Beyer

[11] Patent Number: 4,889,250

[45] Date of Patent: Dec. 26, 1989

[54] VACUUM PUMP AND CLOSURE ASSEMBLY FOR BEVERAGE CONTAINER

[75] Inventor: Michael B. Beyer, Garland, Tex.

[73] Assignee: E Street Enterprises, Inc., Dallas, Tex.

[21] Appl. No.: 213,585

[22] Filed: Jun. 30, 1988

Related U.S. Application Data

[60] Continuation-in-part of Ser. No. 142,449, Jan. 11, 1988, abandoned, which is a division of Ser. No. 929,591, Nov. 12, 1986, Pat. No. 4,723,670, which is a continuation-in-part of Ser. No. 828,542, Feb. 12, 1986, abandoned.

[51] Int. Cl.[4] ..... B65D 51/24

[52] U.S. Cl. ..... 215/228; 215/260; 417/511

[58] Field of Search ..... 215/228, 260; 417/511, 417/545

[56] References Cited

U.S. PATENT DOCUMENTS

| | | | |
|---|---|---|---|
| 460,223 | 9/1891 | Smith | 417/545 X |
| 601,075 | 3/1898 | Gray | 417/545 |
| 3,318,256 | 5/1967 | Green | 417/511 |
| 3,319,577 | 5/1967 | Herreshoff | 417/511 |
| 3,557,986 | 1/1971 | Poole | 215/228 |
| 3,602,387 | 8/1971 | Patnaude et al. | 215/228 X |
| 3,853,222 | 12/1974 | Helms | 206/315 |
| 4,033,091 | 7/1977 | Saponara | 215/228 X |
| 4,287,819 | 9/1981 | Emerit | 215/260 X |
| 4,524,877 | 6/1985 | Saxby | 215/228 |
| 4,763,803 | 8/1988 | Schneider | 215/260 |

*Primary Examiner*—Donald F. Norton
*Attorney, Agent, or Firm*—Dennis T. Griggs

[57] ABSTRACT

A hand-operated vacuum pump is combined with a resilient closure sleeve for sealing and de-pressurizing the open space within a fermented beverage container. A pump cylinder is covered by a resilient closure sleeve which is insertable into the neck of the beverage container. A piston is coupled for extension and retraction through the pump cylinder. The piston carries a floating seal which is axially movable along a reduced diameter portion of the piston for opening and closing an air inlet port between an air transfer annulus and an evacuation chamber. The pump includes an improved check valve assembly in which a suction port is sealed by a resilient membrane which engages a tapered sealing surface in which the suction port is formed.

9 Claims, 5 Drawing Sheets

VACUUM PUMP AND CLOSURE ASSEMBLY FOR BEVERAGE CONTAINER

CROSS REFERENCE TO RELATED APPLICATION

This is a continuation-in-part of pending application Ser. No. 07/142,449, filed Jan. 11, 1988, now abandoned, which is a division of application Ser. No. 06/929,591, filed Nov. 12, 1986, now U.S. Pat. No. 4,723,670, which is a continuation-in-part of application Ser. No. 06/828,542, filed Feb. 12, 1986, now abandoned.

FIELD OF THE INVENTION

This invention relates generally to closures for beverage containers, and in particular to a vacuum pump for evacuating air from a sealed beverage container.

BACKGROUND OF THE INVENTION

Beverages are sold in glass and plastic containers having an interior void space which is pressurized (if carbonated) or evacuated (if fermented) and then sealed by an original factory closure such as a screw cap or cork. The purpose of the closure is to seal the container and maintain the void space under pressure or evacuated until the container is opened for dispensing the beverage. Some beverage containers are relatively small, in the six- to ten-ounce range, and are sealed by a disposable cap which is discarded after the beverage container is opened. Larger beverage containers, for example in the two- to three-liter range, are provided with a reusable screw cap closure for resealing the container after a portion of the beverage has been served.

Carbonated beverages typically contain dissolved carbon dioxide gas which will escape into the atmosphere unless the container is pressurized and sealed. The flavor of such carbonated beverages turns flat in the absence of the dissolved carbon dioxide gas. The loss of carbonation can be reduced somewhat by sealing the beverage container after use. However, because of the relatively large volume of some beverage containers, the carbonization will be released into the unpressurized open space within the container, with the result that the flavor of the remaining beverage is impaired. Accordingly, the quality of the beverage in such larger containers will gradually deteriorate, with the result that a substantial portion of the beverage will become unpalatable, and will be discarded.

The quality and taste of other beverages, for example wine, is affected by exposure to and reaction with oxygen contained within the air. For this reason, the quality and flavor of beverages such as wine which react with oxygen will gradually deteriorate after the wine bottle has been uncorked. For that reason, it is customary to discard any wine which may be left over and not consumed within a few hours after the wine bottle is uncorked.

DESCRIPTION OF THE PRIOR ART

The practice of sealing the open volume within the beverage container to reduce the rate of loss of carbonation from the beverage is commonly accepted. Closure devices having a resilient sealing member for insertion into and engaging the neck of the container have provided a secure seal for the interior volume of the container. However, as the amount of beverage remaining is reduced, the open space grows larger, and more and more of the dissolved carbonation is released from the beverage and into the open space.

It has been recognized and demonstrated that if the open volume within the beverage container is repressurized with ambient air, the amount of dissolved carbon dioxide released from the beverage will be substantially reduced. Pumping devices have been proposed for pressurizing the open volume within the container with ambient air. It is also known to combine a closure cap and pressurizing pump for insertion into the neck of a beverage container. Such prior art pressurizing and closure devices have failed in some instances to develop and maintain the pressure within the open volume of the beverage container at a level greater than the pressure of dissolved gases within the beverage. In some instances, such pump closure devices have been unable to develop a sufficiently high enough pressure within the container open space because of leakage through or around the sealing components of the pump. In other instances, the prior art pumping devices have developed adequate pressure levels initially, but were unable to maintain the interior pressure at the desired level because of leakage.

It has also been recognized and demonstrated that if the volume of air contained within an open wine beverage container is evacuated, the amount of oxygen reaction sustained by the wine beverage remaining in the bottle will be substantially reduced. Pumping devices have been proposed for evacuating the open volume within the wine beverage container to remove up to 95% of the enclosed air. It is also known to combine a closure cap and a pressurizing valve combination for displacing the enclosed air within the wine beverage container with a volume of an inert gas such as argon dispensed through an injector tube from a pressurized cylinder. In some instances, such evacuation pump closure devices have been unable to draw a sufficiently low vacuum level within the container open space because of leakage through or around the sealing components of the pump. In other instances, the prior art vacuum pumping devices have produced a sufficiently low pressure level initially, but were unable to maintain the interior pressure at the desired low vacuum level because of leakage.

SUMMARY OF THE INVENTION

According to one aspect of the present invention, a hand-operated vacuum pump is combined with a closure cap for sealing and de-pressurizing the interior open space within a beverage container. A pump cylinder is integrally formed with a closure screw cap and is insertable into the open space of a beverage container, with the pump cylinder extending through the neck of the container. A piston is mounted by a guide ring for extension and retraction through the pump cylinder. The annular space between the piston and the inside bore of the cylinder sidewall constitutes an air transfer annulus which is sealed by a resilient, annular seal carried by the piston and which engages the inner sidewall of the cylinder. The cylinder bore space on the opposite side of the seal constitutes an evacuation chamber into which air from the container open space is drawn as the piston is pumped.

According to another aspect of the invention, the pump cylinder is provided with an improved check valve assembly in which a transfer port is sealed by a resilient, conformable member which engages a tapered valve seat formed onto an end portion of the cylinder. As a result of resilient flexure of the sealing member against the tapered sealing surface, the forces directed onto the sealing member during stroking movements of the piston and at rest are uniformly distributed across the face of the sealing member, thereby avoiding the creation of wrinkles which could compromise the seal. Moreover, during a down-stroke operation in which air is transferred out of the evacuation chamber and into the air transfer annulus, the resilient member remains securely engaged against the tapered surface surrounding the transfer port. Likewise, during an up-stroke operation in which air is drawn out of the open space of a wine beverage container, the resilient check valve member is easily displaced away from the tapered surface surrounding the transfer port to permit the container open space to be evacuated.

According to another aspect of the de-pressurizing embodiment, the annular piston seal is received about a reduced diameter portion of the piston, and is axially movable along the reduced diameter portion to a first position in which a vent groove formed on the piston is closed and seals the air transfer annulus with respect to the vent groove as the piston and seal retract through the pump cylinder during an up-stroke movement, thereby pumping air admitted by the check valve from the air evacuation chamber. The annular piston seal is axially movable along the reduced diameter portion from the first position to a second position in which the vent groove formed on the piston is open for the admission of air from the air evacuation chamber into the air transfer annulus during a down-stroke movement of the piston.

The superior features and advantages of the present invention will be further appreciated by those skilled in the art upon consideration of the detailed description which follows with reference to the attached drawings, wherein:

DETAILED DESCRIPTION OF THE PREFERRED EMBODIMENTS

Figure 1:
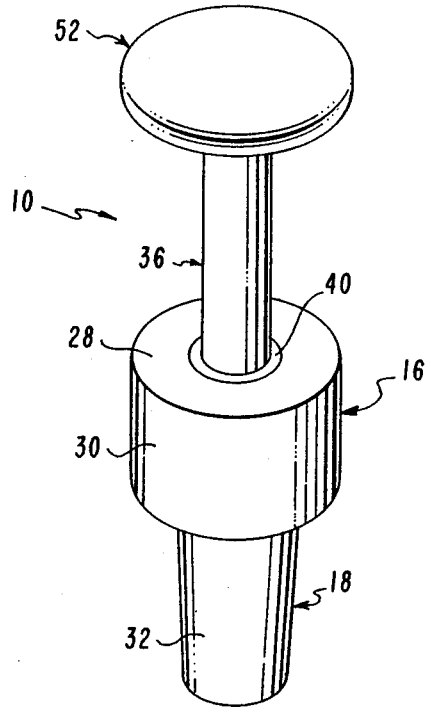
FIG. 1 is a perspective view of the closure cap/pump combination of the present invention.

In the description which follows, like parts are indicated throughout the specification and drawings with the same reference numerals, respectively. The drawings are not necessarily to scale and the proportions of certain parts have ben exaggerated to better illustrate operation of the invention.

The Pressurizing Pump Closure Embodiment

An improved closure cap/pump assembly 10 is provided for sealing a container 12 and for pressurizing a volume of carbonated beverage 14 which is enclosed within the beverage container 12. The assembly 10 includes a closure cap 16 to which a pump 18 is attached. The pump 18 includes a check valve 20 (FIG. 3) which permits ambient air to be pumped into the interior open space 22 of the beverage container 12, while substantially preventing the escape of pressurized gases from the open space 22 in the reverse direction through the pump 18.

The closure cap 16 is provided with threads 24 formed about the inside diameter of the closure cap 16 for engagement with complementary threads (not illustrated) formed about the external sidewall surface of the container neck 26. Compression engagement of the threads, together with the operation of the check valve 20, effectively seal the internal container space 22 to prevent the escape of pressurized gases.

The closure cap 16 is provided with a crown 28 and a cylindrical sidewall 3 integrally formed therewith. Also integrally formed with the crown 28 is a pump housing 32 which is concentrically located with respect to the cylindrical cap sidewall 30. The pump housing 32 is provided with a cylindrical bore 34 which extends through the crown 28. The cylindrical bore 34 is sealed at the opposite end of the pump housing 32 by the check valve assembly 20.

Figure 2:
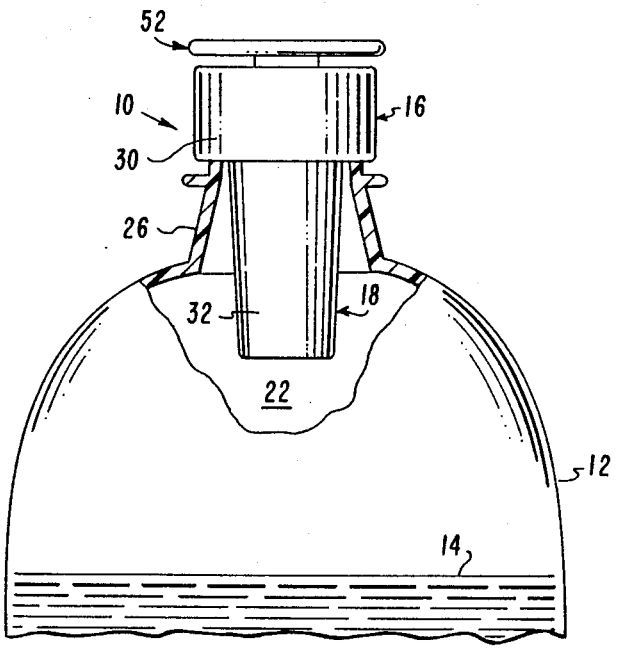
FIG. 2 is an elevation view, partially in section, of the closure cap/pump combination as fitted onto the neck of a beverage container.

Ambient air is pumped into the interior open space 22 through the bore 34 of the pump 18. As can best be seen in FIG. 2, the closure cap 16 is screwed onto the container neck 26 with the pump housing 32 extending through the neck 26 in fluid communication with the container open space 22. When the closure cap 16 is tightly secured to the container neck 26, air discharged through the check valve 20 pressurizes the open space 22 within the container 12.

Figure 3:
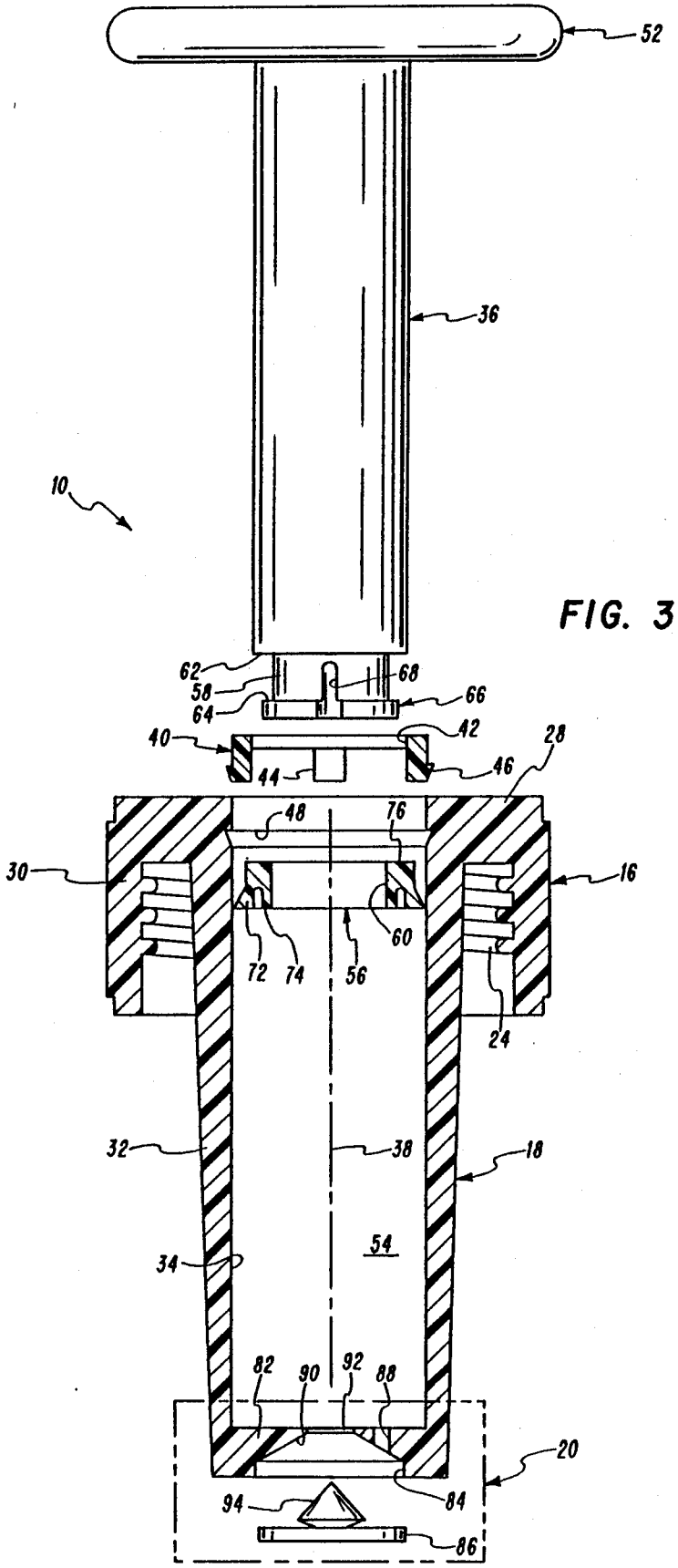
FIG. 3 is an exploded view, partly in section, of the closure cap/pump combination of the present invention.

Referring now to FIGS. 1 and 3, the pump 18 includes a piston 36 which is concentrically received within the cylindrical bore 34 for reciprocal axial movement in extension and retraction along the longitudinal axis 38 of the cylindrical bore 34. The piston 36 is centered within the bore 34 by an annular locator ring 40. The locator ring 40 is provided with a cylindrical bore 42 within which the piston 36 is slidably received. The locator ring 40 is coupled to the crown 28 by locking fingers 44 which carry radially-projecting, tapered shoulders 46. The tapered shoulders 46 are received within an annular groove 48 formed within the cylindrical bore 34 which extends through the crown 28. The annular groove 48 is tapered to accommodate the tapered shoulder 46 of the locking fingers 44. The locking fingers 44 are resilient and deflect radially inwardly as the locator ring 40 is inserted into the piston bore 34. The tapered shoulders 46 snap into engagement within the tapered groove 48, thereby forming an interlocking union.

The diameter of the pump piston 36 is appropriately sized to permit the piston to slip freely through the bore 42 of the locator ring 40. The piston 36 is radially spaced from the bore 34, thereby defining an air supply annulus 50. It will be appreciated that a small clearance exists between the external surface of the piston bore 36 and the surface of the locator bore 42, thereby defining an annular flow passage through which ambient air A can be drawn into the air supply annulus 50.

Pumping action is produced manually by extending and retracting the piston through the pump housing bore 34. The piston 36 is provided with a handle 52 for manually pushing the piston into and withdrawing it out of the pump housing bore 34. The pump housing bore 34 encloses a cylindrical compression chamber 54 through which ambient air is pumped from the surrounding environment into the interior open space 22 of the beverage container 12. The compression chamber 54 is axially bounded by an annular seal 56 which is movably mounted onto and carried by the piston 36.

In particular, the lower end of the piston 36 is provided with a reduced diameter portion 58 onto which the annular seal 56 is mounted. The annular seal 56 is provided with a bore 60 which is fitted for axial sliding movement along the external surface of the reduced diameter piston portion 58. Axial movement of the annular seal 56 relative to the piston 36 is limited in one direction by a radially-projecting shoulder 62, and is limited in the opposite direction by a radial shoulder 64 formed on a flange 66 which terminates the opposite end of the piston 36.

The locator ring 40 and the annular seal 56 cooperate to stabilize movement of the piston 36 through the piston bore 34.

Figure 4:
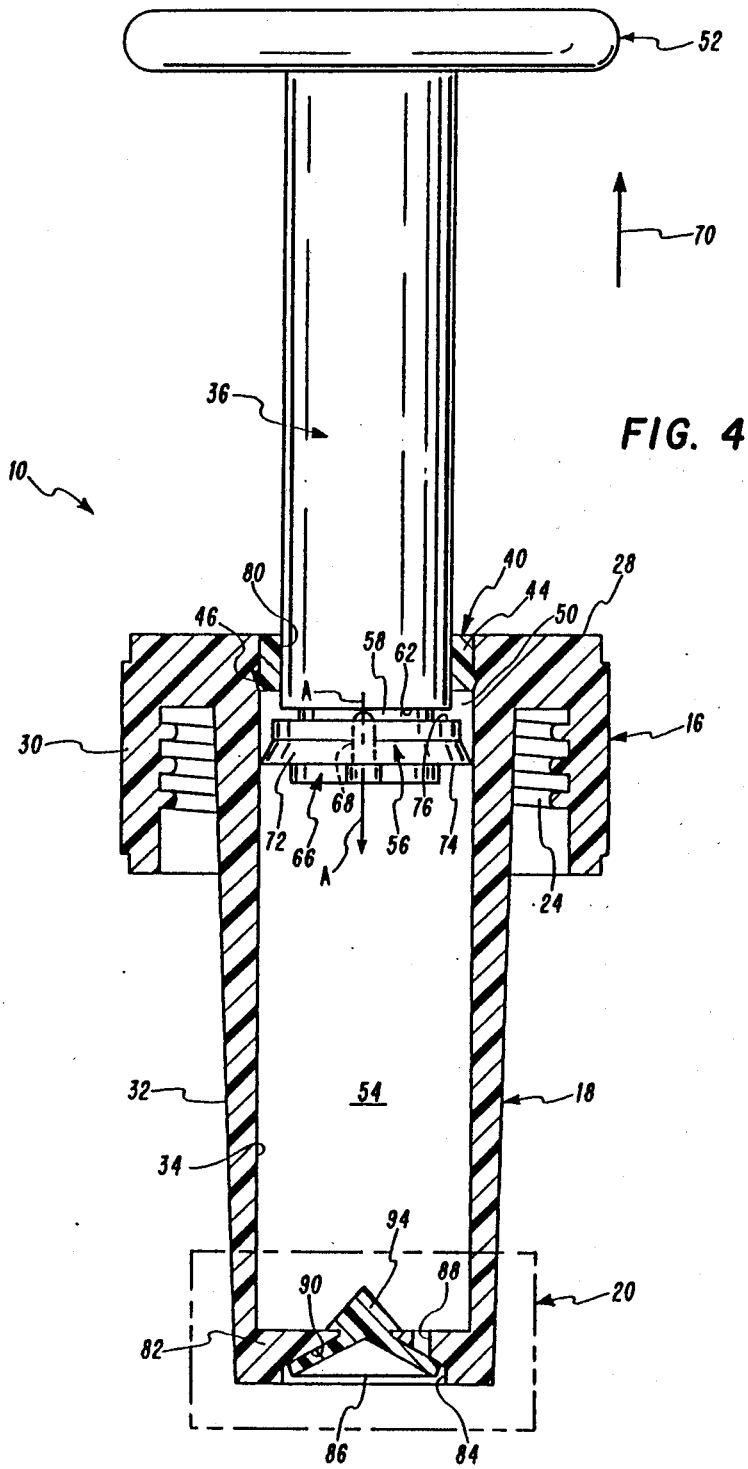
FIG. 4 is a sectional view of the closure cap/pump combination which illustrates the relationship of the pump components during an up-stroke operation.

A shallow groove 68 is formed in the reduced diameter piston portion 58 and extends through the flange 66, thereby providing a flow passage through which air A trapped within the air supply annulus 50 is vented into the compression chamber 54 as the piston 36 is extended out of the pump housing during upstroke operation as indicated by the arrow 70 in FIG. 4.

The annular seal 56 "floats" with respect to the reduced diameter piston portion 58, whereby it is forced into engagement with the radial shoulder 64 of the flange 66 as the piston 36 is extended outwardly during an up-stroke operation, with the result that the inlet port 68 is opened to allow air A trapped in the air supply annulus 50 to be vented into the lower compression chamber 54. The annular seal 56 is provided with a tapered shoulder 72 which resiliently engages the bore 34 of the pump housing 32. The tapered shoulder 72 is provided with a radially-projecting face 74 which bears against the shoulder 64 during the up-stroke operation.

Figure 5:
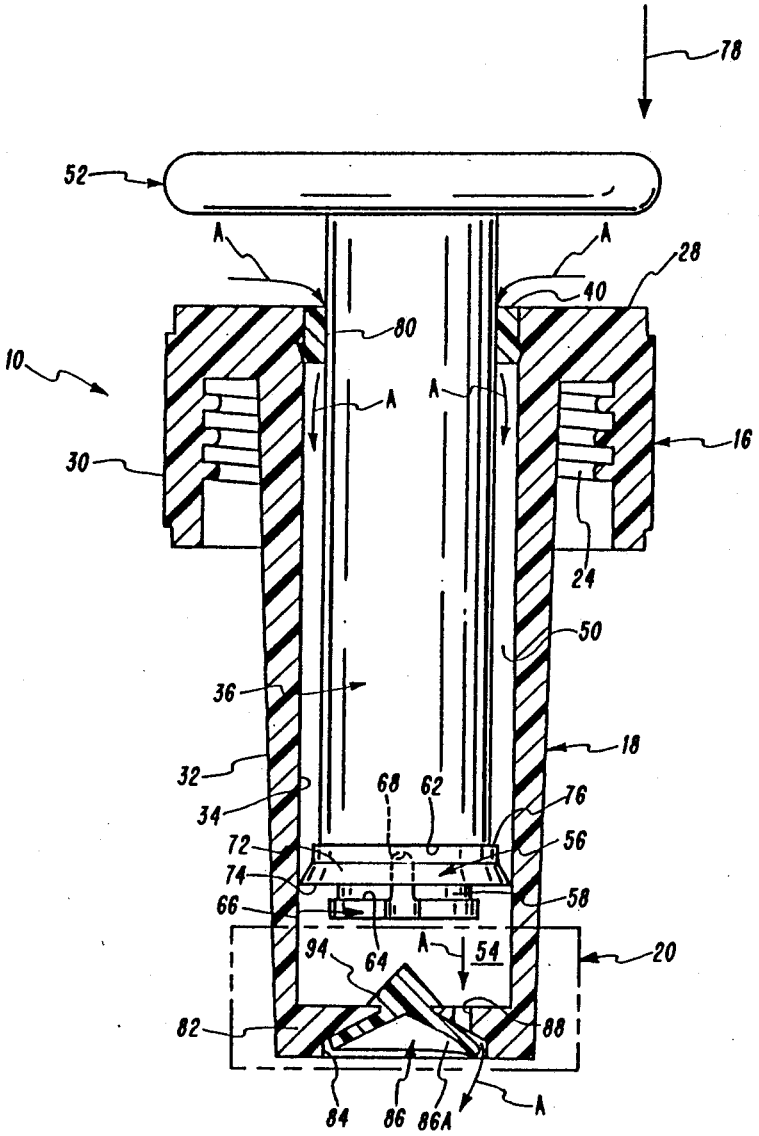
FIG. 5 is a view similar to FIG. 4 which shows the relationship of the pump components during a down-stroke operation.

Referring now to FIG. 5, during down-stroke operation the floating annular seal 56 is forced against the radial shoulder 62, thereby sealing the air supply annulus 50 with respect to the vent passage 68. The floating annular seal 56 is provided with an annular face 76 which bears against the radial shoulder 62 in surface-to-surface engagement. The annular union between the shoulder 62 and the annular face 76, together with the seal provided by the engagement of the resilient flange 72 of the floating seal against the piston bore 34, provide a secure seal which prevents the back flow of air A out of the compression chamber 54 into the air supply annulus 50 during a down stroke as indicated by the arrow 78 in FIG. 5.

Moreover, as the piston 36 and the annular seal 56 are displaced into the piston bore 34, a low pressure condition is created in the air supply annulus 50, which draws ambient air A through the air supply annulus between the piston 36 and the locator ring 40, thus providing a new charge of ambient air A to be transferred into the compression chamber 54 as the piston is withdrawn on the next up stroke.

Figure 6:
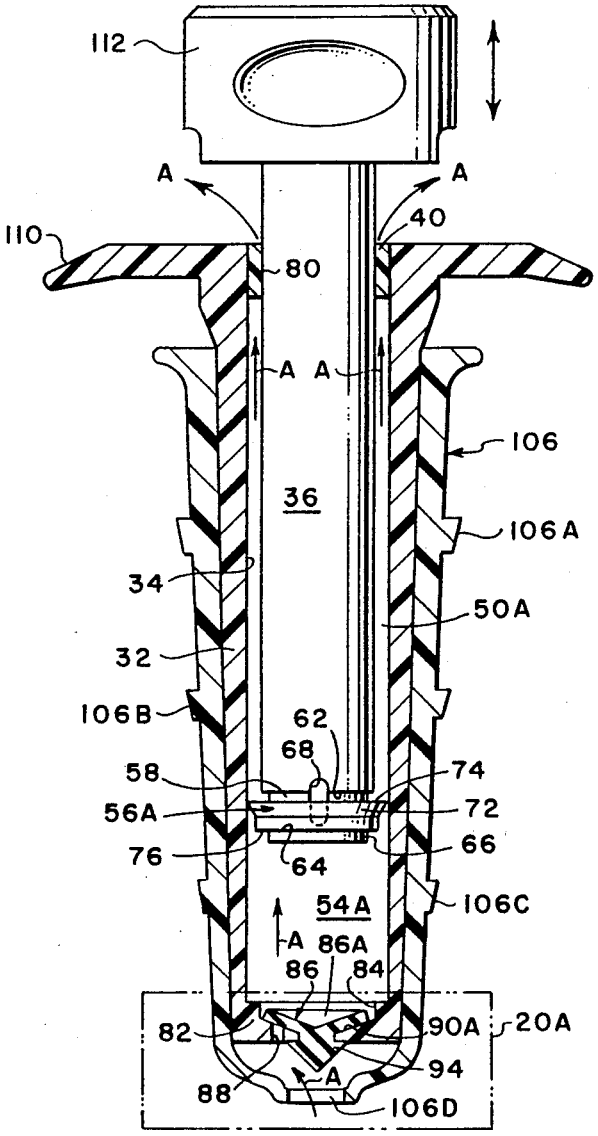
FIG. 6 is a sectional view of the de-pressurizing closure cap/pump embodiment which illustrates the relationship of the pump components during an up-stroke air evacuation operation; and, FIG. 7 is an elevation view of the de-pressurizing closure cap/pump embodiment of FIG. 6 shown inserted into and sealed against the neck of a wine beverage container.

The annular clearance between the piston 36 and the bore 42 of the locator ring 40 is too small to illustrate clearly and is shown only as a line 80 in FIGS. 4, 5 and 6.

Referring again to FIG. 3, the pump housing 32 is sealed by the check valve assembly 20 which is formed on the lower end of the pump housing 32. The chamber 54 is closed by a web 82 which is integrally formed with the pump housing 32. A valve pocket 84 extends axially into the web 82 for receiving a resilient, conformable membrane 86. In the preferred embodiment, the membrane 86 is made of resilient polymer material which assumes the form of a flat disk when unloaded.

A discharge port is provided by a small bore 88 which extends through the web 82, thereby providing a passage for the flow of air out of the compression chamber 44 and into the container interior open space 22.

According to a preferred aspect of the invention, the pocket 84 is enlarged by a tapered bore 90 which extends through the web 82. The apex of the tapered bore 90 is truncated along its line of intersection with the boundary of the compression chamber 54. The intersection of the tapered bore 90 with the compression chamber 54 defines an opening 92 in which a conical fastener portion 94 of the resilient membrane 86 is received.

In particular, the resilient membrane 86 is attached to a resilient, conical fastener 94 which is inserted through the opening 92. The retainer cone 94 is fabricated of a resilient material which resumes its fully expanded configuration after being forced through the opening 92. As the fastener 94 is pushed through the opening 92, the resilient membrane disc 86 is caused to deflect and engage the conical bore 90 as illustrated in FIGS. 4 and 5.

As a result of the resilient flexure of the membrane disc 86 against the tapered sealing surface 90, the forces directed onto the membrane during an up-stroke operation, as shown in FIG. 4, and at rest, are uniformly distributed across the face of the membrane, thereby avoiding the creation of wrinkles which could compromise the seal.

During a down-stroke operation as illustrated in FIG. 5, the resilient membrane 86 is easily displaced by the compressed air A away from the tapered surface 90 which surrounds the discharge port 88, thereby permitting the flow of compressed air A from the compression chamber 54 through the bore 8 and into the container interior space 22. The lip 86A is deflected radially inwardly and away from the web 82 in response to the force developed by the compressed air A, thereby relieving the compression chamber 54 during down-stroke movement of the piston 36.

Additionally, as the floating annular seal 56 is pulled upwardly through the bore 34, a vacuum is produced in the chamber 54 which draws the lip of the resilient membrane against the tapered bore 90, thereby tightly sealing the discharge port 88.

After a portion of the carbonated beverage 14 has been served from the container 12, the factory installed closure cap is discarded and the container 12 is sealed by the closure cap/pump combination 10 by inserting the pump 18 through the neck 26 of the container and twisting the closure cap 16 to tightly seal the dispensing opening in the neck 26. After a substantial portion of the carbonated beverage has been served, the interior open space 22 of the container should be pressurized to a pressure level great enough to inhibit the release of dissolved carbon dioxide from the carbonated beverage 14. This is accomplished by manually operating the pump 18 to force ambient air A into the interior open space 22 by manually reciprocating the piston 36. Upon an up stroke of the piston 36, air is transferred from the annulus 50 into the compression chamber 54 through the vent passage 68, and during a down-stroke operation, the floating annular seal 56 effectively seals the compression chamber 54, with air A previously drawn into the compression chamber being forced through the discharge port 88 of the check valve 20.

Reciprocal movement of the floating annular seal 56 about the reduced diameter piston portion 58 permits the efficient charging of the compression chamber and the effective sealing of the compression chamber during a down stroke so that the desired high-pressure levels can be established within the interior open space 22 within the container 12. The resilient membrane disc 86 securely seals the discharge port 88 of the check valve 20, thereby preventing the escape of the compressed gases out of the pressurized open space 22 of the container after the desired pressure level has been achieved. The check valve is operable independently of the piston, and provides a secure seal against back flow at all times, so that it is not necessary to rotate or otherwise displace the piston 36 to secure the seal after a pumping operation has been completed.

The De-Pressurizing Pump Closure Embodiment

Figure 7:
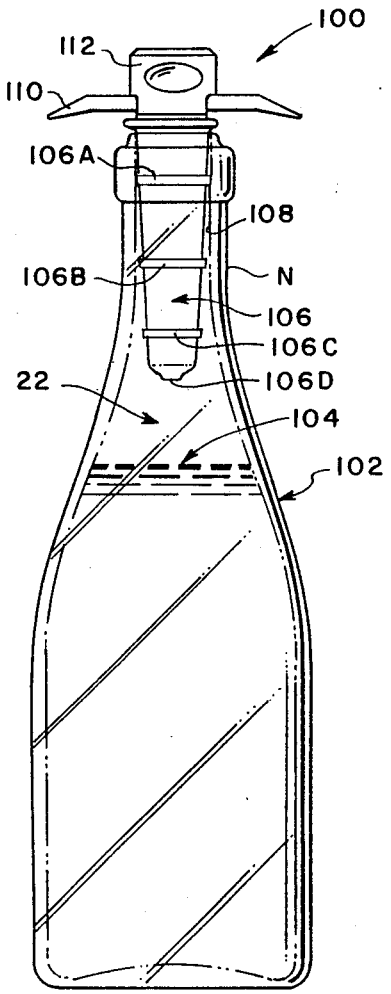

Referring now to FIGS. 6 and 7, a de-pressurizing pump closure assembly 100 is insertable into the neck N of a wine bottle 102 for evacuating air from the void space 22 above the wine beverage 104. According to this arrangement, a screw cap closure is not utilized; instead, a resilient, tubular sleeve or jacket 106 is fitted about the pump housing 32 for producing a fluid seal between the pump housing and the inside cylindrical bottle neck surface 108. The de-pressurizing pump closure assembly 100 is held securely in sealing engagement against the inside bottle neck surface 108 by the vacuum force produced by operation of the pump, and by a compression of the resilient jacket between the pump housing and the bottle neck surface 108.

The resilient jacket 106 is provided with annular seal ring portions 106A, 106B and 106C. The annular seal ring portions project radially from the tubular sleeve 106, and at least one ring is compressed between the pump cylinder housing 32 and the inside diameter bore surface 108 of the bottle neck N as the pump assembly 100 is inserted, thereby producing a secure fluid seal.

The lower end of tubular sleeve 106 is provided with an opening 106D through which air A is drawn from the open air space 22 and through the inlet port 88 of check valve assembly 20A. By comparison with the check valve assembly 20 shown in the pressurizing embodiment of FIG. 4, it will be seen that the resilient closure element 86 is identical, but is mounted in an inverted relationship to permit one-way withdrawal of air from the container open space 22 through the inlet port 88. In the inverted check valve assembly 20A as shown in FIG. 6, the valve seat surface 90A is formed on the inside surface of web 88, and the retainer cone 94 projects externally of the pump housing web 82.

The reduced diameter jacket opening 106D is also used to manually test the effectiveness of the pump assembly 100. Vacuum operation is confirmed by closing the opening 106D with a finger, and then drawing the piston 36 upwardly. The pull of the vacuum force induced by pumping retraction of the piston 36 is sensed through the finger which covers the jacket opening 106D.

A handle 110 is formed onto the pump cylinder 32 for facilitating the insertion and withdrawal of the pump assembly 100 into and out of the container neck N. Likewise, the piston 36 is provided with a handle 112 which is used for manually reciprocating the piston 36 to produce the pumping action.

The pumping action for the de-pressurizing pump assembly 100 is essentially the reverse of the pumping action of the pressurizing pump embodiment 10. Referring again to FIG. 6, pumping action is produced manually by extending and retracting the piston 36 through the pump housing bore 34. The piston handle 112 is provided for manually pushing the piston into and withdrawing it out of the pump housing bore 34. The pump housing bore 34 encloses a cylindrical evacuation chamber 54A into which ambient air is drawn from the open space 22 through the check valve assembly 20A. The evacuation chamber 54A is axially bounded by the annular seal 56A which is movably mounted onto and carried by the piston 36

The annular seal 56A is mounted onto a reduced diameter portion 58 of the piston 36. The annular seal 56A is dimensioned for axial sliding movement along the external surface of the reduced diameter piston portion 58. Axial movement of the annular seal 56A relative to the piston 36 is limited in one direction by the radially projecting shoulder 62, and is limited in the opposite direction by the radial shoulder 64 which is formed on a flange portion 66 which terminates the opposite end of the piston 36.

The shallow groove 68 provides a vent passage through which air A admitted into the evacuation chamber 54A through the check valve assembly 20A is transferred into the air transfer annulus 50A during a down-stroke of piston 36.

The annular seal 56A "floats" with respect to the reduced diameter piston portion 58, whereby it is forced into engagement with the radial shoulder 64 of the flange 66 as the piston 36 is extended outwardly during an up-stroke movement, with the result that the vent passage 68 is closed, thereby forcing air contained within the cylinder transfer annulus 50A to be discharged across the locator ring 40. As this occurs, the evacuation chamber 54A is de-pressurized, thereby creating a pressure differential across the resilient closure disc 86. The flexible, resilient disc 86 deflects away from the valve seat surface 90A as air A is drawn from the open region 22 through the check valve assembly 20A.

Upon reversal of the piston movement, the check valve 20A closes, thereby maintaining the established vacuum within the container open space 22 as the recently admitted air A within the evacuation chamber 54A is transferred through the piston vent passage 68.

After the wine bottle 102 has been uncorked and a portion of the wine beverage 104 has been served, the cork or other factory installed closure cap is discarded and the container 102 is sealed by the closure cap pump combination 100 by inserting the pump through the neck end of the wine bottle until at least one of the annular seal members 106A, 106B or 106C is securely engaged against the interior neck surface 108. After a substantial portion of the wine beverage has been served, the interior open space 22 of the container 102 should be depressurized to a reduced pressure level sufficient to remove approximately 95% of the enclosed air which will substantially reduce the amount of oxygen available to react with the wine beverage.

After the pump assembly 100 is lodged securely within the neck end of the wine bottle 102, the empty space 22 is evacuated by manually reciprocating the piston 36. Upon upstroke of the piston 36, air previously transferred from the evacuation chamber 54A through the vent passage 68 is forced out of the annular transfer chamber 50A and into the surrounding atmosphere. During a down-stroke operation, the floating annular seal 56A is shifted along the reduced diameter piston portion 58 into engagement with shoulder 62, thereby opening vent passage 68 into communication with the evacuation chamber 54A. Air accumulated within the evacuation chamber 54A is thus transferred into the transfer annulus 50A for removal upon the next upstroke. The check valve assembly 20A opens automatically upon an up-stroke of the piston 36 and closes automatically upon a downstroke, so that it is not necessary to rotate or otherwise displace the piston 36 to secure sealing engagement of the resilient disc 86 against the valve seat 90A after a pumping operation has been completed. That is, the pressure differential across the resilient membrane 86 arises because of the relatively high pressure within the evacuation chamber 54A, which is at atmospheric pressure (760 torr) relative to the vacuum pressure level induced within the open space 22 as a result of pumping action, which approaches 40–50 torr.

The components of the de-pressurizing pump assembly 100 are mechanically identical with the corresponding components utilized by the pressurizing pump closure assembly 10. However, the piston seal 56 and the resilient membrane 86 of the check valve assembly 20 are inverted, thereby reversing the pumping direction so that air is drawn out of the container open space 22 as the piston 36 is reciprocated.

Although the invention has been described with reference to a carbonated beverage application and a fermented wine beverage application, the foregoing description is not intended to be construed in a limiting sense. Various modifications of the preferred embodiments as well as alternative applications of the invention will be suggested to persons skilled in the art by the foregoing specification and illustrations. For example, the combination closure cap/pump assembly of the present invention can be incorporated with other air-pressurized devices in which it is desired to maintain a specific pressure or vacuum level. It is therefore contemplated that the appended claims will cover any such modifications or embodiments that fall within the true scope of the invention.

What is claimed is:

1. A pump and closure assembly for depressurizing the interior open space within a beverage container comprising:

a closure member;

a pump having a housing attached to said closure member, said pump housing having a cylindrical bore and a piston mounted for extension and retraction through said bore;

an annular seal mounted on said piston, said annular seal engaging said bore and defining the boundary of an evacuation chamber within said bore on one side of said annular seal and an air transfer annulus being defined between the piston and the pump cylinder bore on the other side of the seal;

valve means coupled to said piston for connecting and disconnecting said evacuation chamber in fluid communication with said air transfer annulus in response to reciprocal movement of said piston;

a check valve coupled to said pump housing, said check valve having a transfer port in communication with said evacuation chamber and a movable valve element for covering and uncovering said transfer port;

said pump housing having a portion defining a pocket in which said transfer port is formed and in which said movable valve element is received, said movable valve element comprising a flexible member coupled to said housing, said flexible member overlying said transfer port; and, said pocket portion defining a conical valve seating surface within said pocket, and said transfer port comprising a bore intersecting said web and said conical seating surface.

2. A pump and closure assembly for depressurizing the interior open space within a beverage container comprising:

a closure member;

a pump having a housing attached to said closure member, said pump housing having a cylindrical bore and a piston mounted for extension and retraction through said bore;

an annular seal mounted on said piston, said annular seal engaging said bore and defining the boundary of an evacuation chamber within said bore on one side of said annular seal and an air transfer annulus being defined between the piston and the pump cylinder bore on the other side of the seal;

valve means coupled to said piston for connecting and disconnecting said evacuation chamber in fluid communication with said air transfer annulus in response to reciprocal movement of said piston;

a check valve coupled to said pump housing, said check valve having a transfer port in communication with said evacuation chamber and a movable valve element for covering and uncovering said transfer port; and, said pump housing including a web portion in which said transfer port is formed, said web portion having a sloping sidewall defining a pocket in which said movable valve element is received, said movable check valve element comprising a flexible member coupled to said web, said flexible member resiliently engaging said sloping sidewall and covering said transfer port.

3. A pump and closure assembly for depressurizing the interior open space within a beverage container comprising:

a closure member;

a pump having a housing attached to said closure member, said pump housing having a cylindrical bore and a piston mounted for extension and retraction through said bore;

an annular seal mounted on said piston, said annular seal engaging said bore and defining the boundary of an evacuation chamber within said bore on one side of said annular seal and an air transfer annulus being defined between the piston and the pump cylinder bore on the other side of the seal;

valve means coupled to said piston for connecting and disconnecting said evacuation chamber in fluid communication with said air transfer annulus in response to reciprocal movement of said piston;

a check valve coupled to said pump housing, said check valve having a transfer port in communication with said evacuation chamber and a movable valve element for covering and uncovering said transfer port;

said piston having a reduced diameter portion and a vent groove formed on said reduced diameter portion; and, said annular seal being mounted on said reduced diameter piston portion for axial displacement from a first position to a second position along said reduced diameter portion, said seal defining the boundary of an evacuation chamber within said bore on one side of the seal, and an air transfer annulus being defined between the piston and the pump cylinder bore on the other side of the seal, said seal having a resilient, annular shoulder engaging said piston bore and said piston and sealing the air transfer annulus with respect to said vent groove when said seal is in the first position, and said seal being movable to the second position on said reduced diameter piston portion wherein said vent groove is in communication with the air transfer annulus and the evacuation chamber.

4. A pump and closure assembly for depressurizing the interior open space within a beverage container comprising:

a pump having a housing and a piston, said pump housing having a cylindrical bore and said piston being mounted for extension and retraction through said cylindrical housing bore;

a closure member attached to said pump housing, said closure member including a tubular sleeve of the resilient material disposed about said pump housing, said tubular sleeve having an annular seal member projecting radially from the sidewall of said sleeve;

an annular seal mounted on said piston, said piston seal engaging said housing bore and defining the boundary of an evacuation chamber within said bore on one side of said piston seal and an air transfer annulus being defined between the piston and the pump cylinder bore on the other side of said piston seal;

valve means coupled to said piston for connecting and disconnecting said evacuation chamber in fluid communication with said air transfer annulus in response to reciprocal movement of said piston; and, a check valve coupled to said pump housing, said check valve having a transfer port in communication with said evacuation chamber and a movable valve element for covering and uncovering said transfer port.

5. A pump and closure assembly as defined in claim 4, said tubular sleeve having a first open end portion, a second open end portion and a tubular sidewall extending between said first and second open end portions, said pump housing being inserted into one of said open end portions and compressively engaged by said tubular sidewall.

6. A pump and closure assembly as defined in claim 4, tubular sleeve having an open end portion defining an inlet port which is in fluid communication with said check valve transfer port, said inlet port having an opening size which can be blocked by a person's finger for sensing the vacuum draw operation of said pump.

7. A pump and closure assembly for depressurizing the interior open space within a beverage container comprising, in combination:

a pump having a housing and a piston, said pump housing having a cylindrical bore and said piston being mounted for extension and retraction through said pump housing bore;

a resilient flange disposed between said piston and said pump housing bore providing a fluid seal between an evacuation chamber within said pump housing bore on one side of said resilient flange and an air transfer annulus defined between the piston and the pump housing bore on the other side of the flange;

valve means coupled to said piston for connecting said evacuation chamber in fluid communication with said air transfer annulus in response to extension of said piston through said pump housing bore and disconnecting said evacuation chamber in response to retraction of said piston through said pump housing bore;

a check valve coupled to said pump housing, said check valve having a transfer port in communication with said evacuation chamber and a movable valve element for covering said transfer port in response to extension of said piston through said pump housing bore and uncovering said transfer port in response to retraction of said piston through said pump housing bore; and, a closure member attached to said housing, said closure member including a tubular sleeve of resilient material disposed about said pump housing, said pump housing and sleeve being adapted for insertion into the internal neck passage of a beverage container, and said tubular sleeve providing a fluid seal between said pump housing and said neck passage sidewall surface when said pump housing and sleeve are inserted into said neck passage, said tubular sleeve having a first open end portion, a second open end portion and a tubular sidewall extending between said first and second open end portions, said pump housing being inserted into one of said open end portions and compressively engaged by said tubular sleeve sidewall, and the other open end portion projecting externally of said pump housing and having an inlet port which is in fluid communication with said check valve transfer port.

8. A pump and closure assembly as defined in claim 7, said tubular sleeve having an annular seal ring portion projecting radially from the sidewall of said sleeve.

9. A pump and closure assembly as defined in claim 7, said inlet port having an opening size which can be blocked by a person's finger for sensing suction draw operation of said pump.

* * * * *